US005215200A

United States Patent [19]

Rosenthal

[11] Patent Number: 5,215,200

[45] Date of Patent: Jun. 1, 1993

[54] MERCHANDISING SYSTEM

[75] Inventor: Gunter Rosenthal, St-Benoit, Canada

[73] Assignee: G. Rosenthal Import Ltd., Montreal, Canada

[21] Appl. No.: 813,520

[22] Filed: Dec. 26, 1991

[51] Int. Cl.[5] ..... A47F 5/08

[52] U.S. Cl. ..... 211/88; 211/187

[58] Field of Search ..... 211/87, 88, 187, 94

[56] References Cited

U.S. PATENT DOCUMENTS

| | | | |
|---|---|---|---|
| 648,888 | 5/1900 | Sullivan | 211/88 |
| 1,245,744 | 11/1917 | Leibner | 211/87 X |
| 3,101,681 | 8/1963 | Stereater | 211/187 X |
| 3,502,294 | 3/1970 | Kalbow et al. | 211/88 X |
| 3,682,426 | 8/1972 | Owen | 211/88 X |
| 3,711,048 | 1/1973 | Thalenfeld | 211/88 X |

*Primary Examiner*—J. Franklin Foss
*Attorney, Agent, or Firm*—Samuel Meerkreebs

[57] ABSTRACT

In a merchandising system of the type utilizing a pegboard, slatboard, or wire grid, a wire rack is provided which includes hook brackets for suspending the wire rack on the display panel, and the wire rack includes several collars formed thereon for receiving a reusable container wherein the container includes bulk products for sale and is provided with a flange or rim extending from the top of the container adjacent the opening therein. The collar on the wire rack is of such a size as to receive the container and support the container by its flange. A large circular bar extends along the front of the wire rack to which identification clips can be mounted.

5 Claims, 3 Drawing Sheets

MERCHANDISING SYSTEM

BACKGROUND OF THE INVENTION

1. Field of the Invention

The present invention relates to merchandising systems, and more particularly, to the type comprising a display panel, such as a pegboard, slatboard, wire grid, or the like, and improved display devices for mounting thereon.

2. Description of the Prior Art

Merchandising units of the type involving pegboard display panels or the like are well known. Such panels are easy to use since any number of shelves or hanging arms can be accommodated without the use of fasteners or having to mount such displays permanently to a wall. Hook-type brackets are provided which can be mounted, without fasteners, at almost any desired location on a vertical panel. Examples of such brackets and display devices are described in many prior art patents of which the following are but a few examples: U.S. Pat. Nos. 2,812,852, Samuels, 1957; 4,322,006, Marschak, 1982; 4,511,047, Elinsky, 1985; 4,560,062, Valiulis, 1985; 4,905,846, Calvert, 1990; and Canadian Pat. No. 1,230,105, Hoefkes, 1987. All of these patents have in common a display panel of the type including pegboards, slatboards, wire grids or the like, a tray, a wire rack or shelf with brackets for suspending it from the display panel, and a container or the actual product.

When the product is held directly by the wire rack or arm, it is usually in the form of a o blister pack or other prepackaged product. Paint brushes and other hangable items can be readily suspended as well. Because of ecological concerns and the desire to reduce the amount of disposable packaging, more small item products are now shipped in bulk containers, in the form of trays or other easily accessible packages and supported on a wire rack or shelf. Such a solution is an improvement, as far as conservation is concerned, but the tray or package must be sturdy and have a relatively low profile in order to remain balanced on the shelf or wire rack, while customers retrieve products from such containers. Most such containers rest on the shelf or wire rack without other forms of support, save for side wall supports sometimes built on the rack.

SUMMARY OF THE INVENTION

It is an aim of the present invention to provide an improved rack for supporting bulk containers on a display panel.

It is a further aim of the present invention to provide an improved combination of rack and container whereby less material and thus a lighter combined structure is provided while improving stability and accessibility of the container when on the rack.

It is a further aim of the present invention to provide an improved merchandising system including lightweight reusable bulk containers.

A construction in accordance with the present invention relates to a merchandising system of the type including a vertical display wall having a consistent pattern of discrete openings for receiving z>hook-type brackets for suspending a rack, wherein the invention is a combination of a rack and container wherein the rack has a frame means extending from its bracket and part of the frame defines a closed loop in the form of a collar, and the container includes a top opening and a rim defined about the opening wherein the rim has a greater outer dimension than any other portion of the container below the rim, the collar of the rack being such as to allow the container to be inserted therein but to engage the rim so as to at least partly support the container by the rim.

In a more specific embodiment of the present invention, the rack is a wire rack and the collar includes wire rods forming the closed loop conforming to the outline of the rim on the container. The container is a semi-rigid, lightweight tray, and the wire rack has bottom support elements to support the bottom of the tray.

A merchandising system has been developed utilizing the above elements and includes the prepackaging in bulk of items to be sold, in the semi-rigid, lightweight tray containers to which is applied o a removable lid on the top thereof. Thus, the tray is filled at a warehouse and shipped to the retail outlet and placed directly into a wire rack on a display panel, such as a pegboard, for instance, at the point of sale. The lid is then removed, exposing the bulk products within the tray. When the tray is empty, it is simply replaced and returned to the warehouse where it is washed and refilled, and a new lid is applied thereto.

If a rigid container is used, such as a wire mesh tray, the wire rack need not have bottom supports but merely the so-called collar or a closed loop conforming to the outline of the rim at the top edge of the tray. Likewise, deeper containers, such as elongated tubular containers, can be provided with a rim or flange at the top edge thereof, and the container is placed in the wire rack and supported by the collar underneath the rim thereof.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 3:
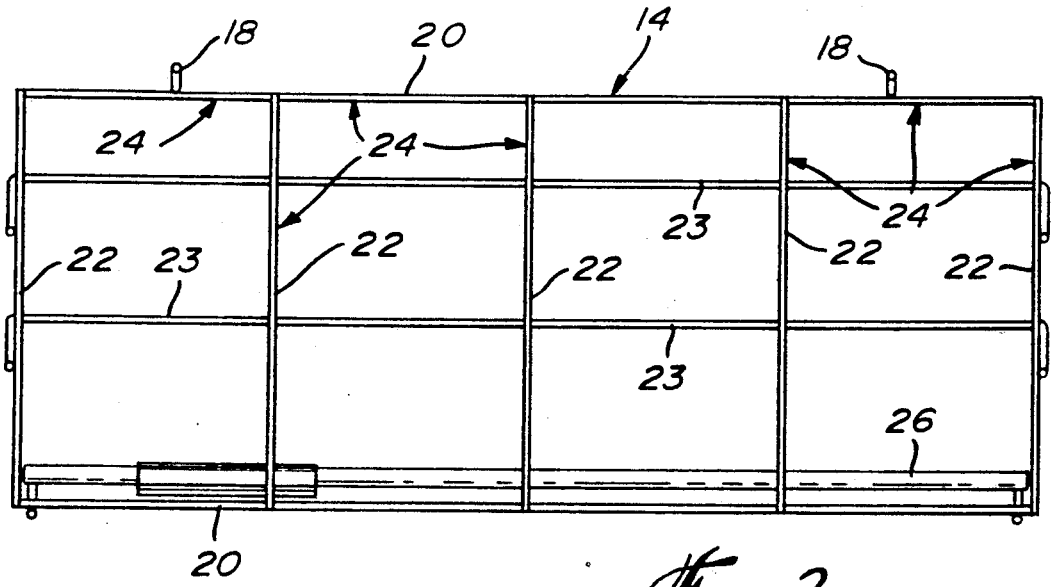
FIG. 3, is a top plan view of the wire rack shown in FIG. 2 with the trays removed.

Referring now to the drawings, there are shown three separate embodiments which will be described in sequence starting with the embodiment illustrated in FIGS. 1, 2, and 3.

Figure 1:
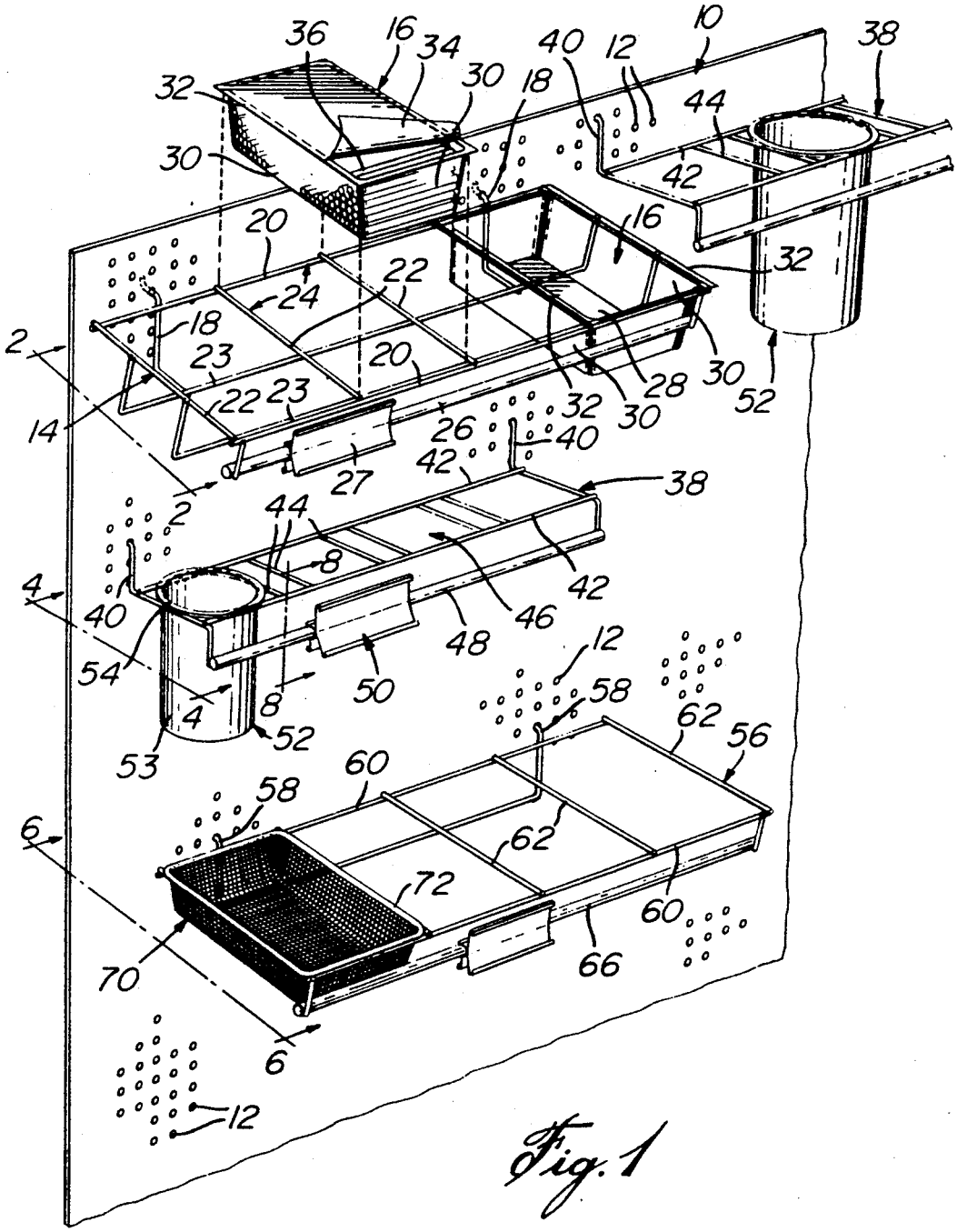
FIG. 1 is a fragmentary perspective view of a display panel on which a number of wire rack embodiments with various containers in accordance with the present invention have been illustrated.
Figure 2:
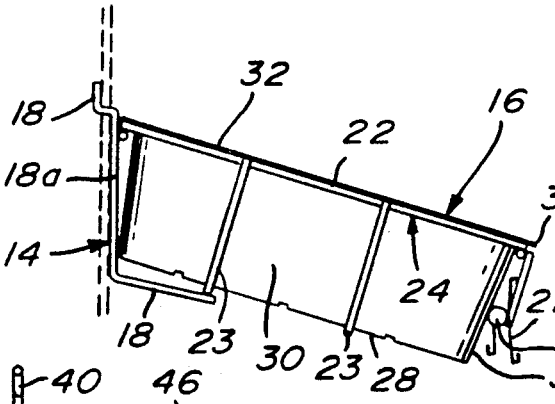
FIG. 2 is a fragmentary end elevation, taken along line 2—2 of FIG. 1.

In FIG. 1, a pegboard 10 is shown with discrete openings 12 provided in a consistent pattern over the whole of the pegboard for receiving hook-type brackets mounting shelving or wire racks of the type shown. In this embodiment, there is provided a wire rack 14 made up of a plurality of wire rods and including hook brackets 18 of the type which are bent o rearwardly and upwardly to be inserted into a pegboard. The hook brackets 18 each have a downwardly extending portion 18*a* which abuts against the pegboard and provides the angle of disposition of the wire rack on the pegboard.

The wire rack has a frame made up of longitudinal rods 20 connected by means of lateral rods 22. Several lateral rods 22 are provided in a spaced-apart parallel arrangement defining collars 24 between them with portions of the lateral rods 20. The dimensions of the collars 24 conform with the bottom of the rim of a container 16 which will be described in more detail. At the front of the wire rack 14 is a bar 26 which is mounted by welding to a pair of short wires from one of the longitudinal rods 20. The bar 26 is provided for mounting an identification clip 27 which will be described in more detail.

In the present embodiment, the wire rack 14 is also provided with bottom supports which are made up of longitudinal wire rods 23 bent at the ends to be welded to the lateral rods 22 at the extremities of the frame. These rods 23 will support the bottom of the containers seated in the collars 24. Each container 16, in the case of a semi-rigid transparent plastic material, has somewhat the construction of a blister pack, and includes a bottom wall 28, side walls 30, and a rim or flange 32 extending continuously about the top edge of the container 16. The flange 32 is dimensioned to fit over the collar 24 formed by pairs of lateral rods 22 and longitudinal rods 20.

The container 16 may be filled at a supply site, such as a warehouse, with bulk items 36, and a removable lid 34 is provided on the top open end of the container. The container 16 will be shipped to the retail outlet and placed in the wire rack 14 on the pegboard 10. The lid 34 is then removed and discarded. When all of the products in the container 16 have been sold, the container is removed and replaced with a prefilled container, and the empty container 16 is returned to the source where it is washed and refilled, and a new temporary lid 34 is placed thereon. Thus, it can be seen that material waste is kept to a minimum.

The construction of the wire rack is such as to allow the container in which the bulk products are shipped, to be of a lightweight semi-rigid construction as the container is supported both by the collar 24 and by the bottom support rods 23. Thus, the material used for forming the container 16 is kept to a minimum as well.

Figure 5:
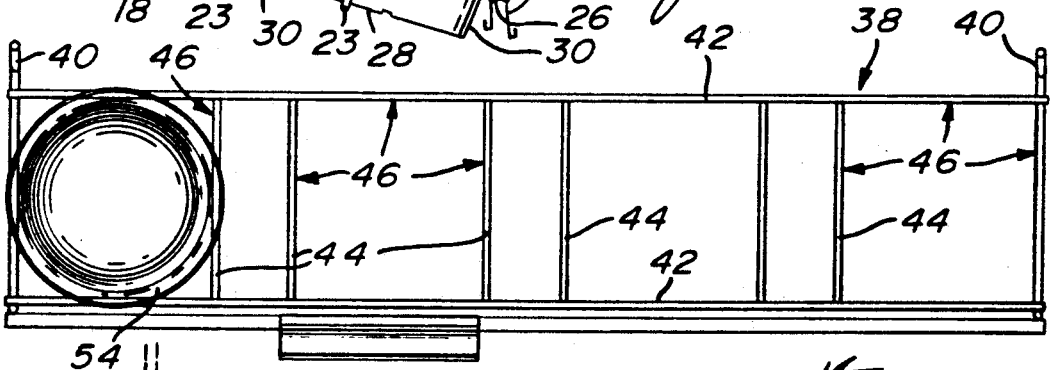
FIG. 5 is a top plan view of the element shown in FIG. 4.
Figure 4:
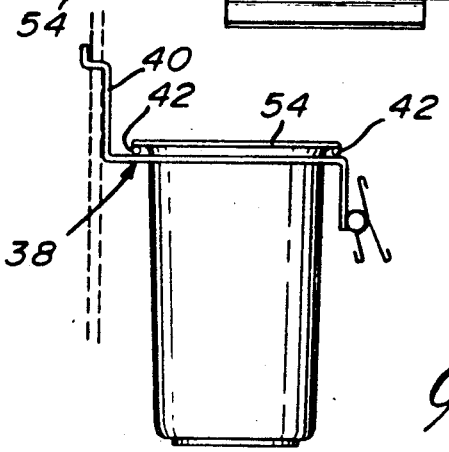
FIG. 4 is an end elevation, taken along line 4—4 of FIG. 1, showing a different embodiment of the wire rack and container combination of the present invention.

The second embodiment illustrated in the specification is shown in FIGS. 4 and 5 and FIG. 1. A wire rack 38 is illustrated having hook brackets 40. The frame of the wire rack 38 is made up by longitudinal wire rods 42 connected by lateral spaced-apart parallel wire rods 44 welded thereto. The hook brackets 40 are in the form of a bent wire rod which also substitutes for the lateral rods at the ends of the wire rack 38 and extends downwardly in the front to which the bar 48 is welded. An identification clip 50 can be mounted to the bar 48.

Collars 46 are formed by lateral rods 44 and longitudinal rods 42 to receive a container 52. The container 52 is a deep jar-type container having a body 53 and a rim or flange 54 at the top open end thereof. The flange 54 is supported by the collar 46 made up of rod portions 44 and 42. Thus, the container 52 can be supported on the wire rack, and it is maintained in a stable condition while products are removed therefrom. The container 52 is of a rigid plastics material, and thus no bottom supports are provided in the wire rack 38.

Figure 7:
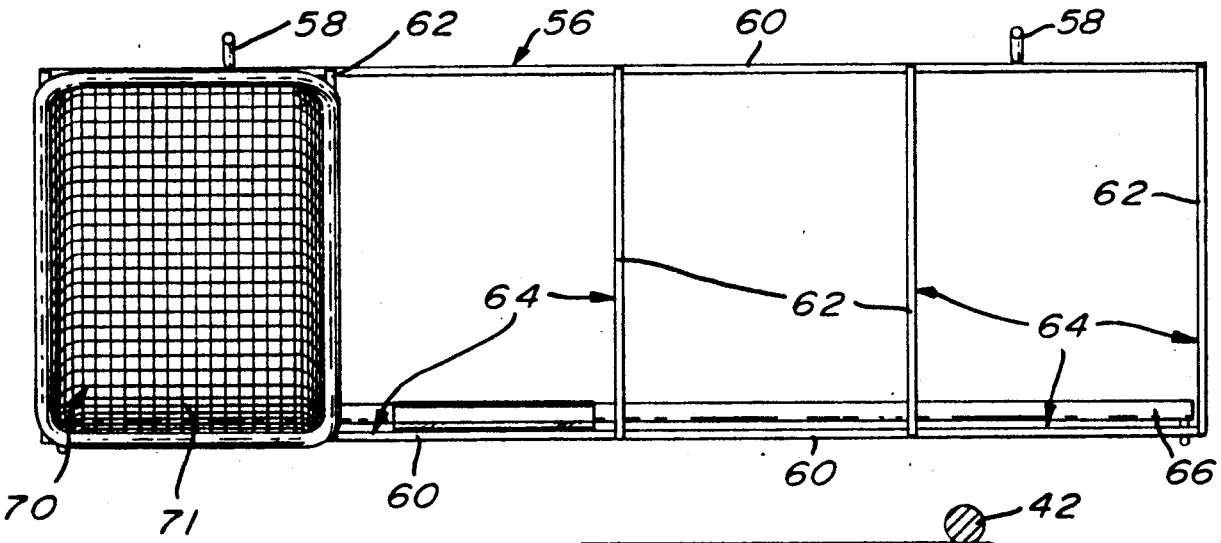
FIG. 7 is a top plan view of the element shown in FIG. 6.
Figure 6:
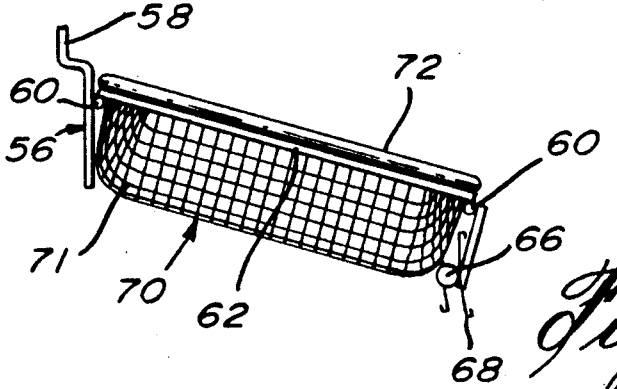
FIG. 6 is an end elevation, taken along line 6—6 of FIG. 1, showing a further embodiment of the present invention; .

The third embodiment illustrated herein is shown in FIGS. 6 and 7 as well as in FIG. 1. The wire rack 56 of this embodiment includes a frame made up of longitudinal rods 60 crossed by lateral rods 62 and welded thereto. A hook bracket 58 is provided, and in this embodiment, it is U-shaped and is welded to a longitudinal rod 60. There are no bottom supports in this particular wire rack as it will support a rigid tray-like container formed of a wire mesh.

The container 10 includes a wire mesh tray portion 71 and a rim 72 formed of a continuous wire rod extending beyond the dimensions of the tray 71 per se. The wire rack 56 defines collars 64 made up of rods 60 and 62 to receive the tray container 70, and the rim 72 is seated on the collar as shown in FIGS. 6 and 7. In this embodiment, the wire mesh tray 71 is rigid and does not need bottom supports and is, therefore, completely supported by the collar 64.

Thus, the trays and containers illustrated in this specification are all supported by collars at o the top rim of the open top container, thereby providing stability to the container held on the rack while products are removed therefrom. The construction simplifies the wire rack container removing material and weight both from the rack and the container itself.

Figure 8:
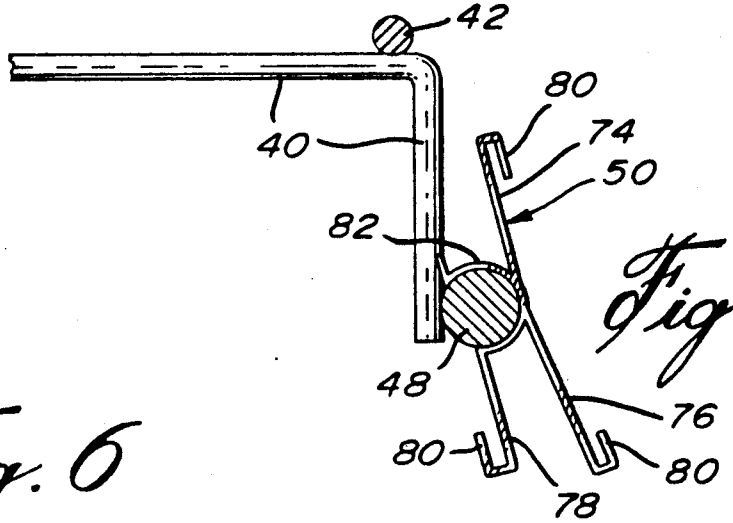
FIG. 8 is a fragmentary enlarged vertical cross-section, taken along line 8—8 of FIG. 1.

In FIG. 8, the identification clip is illustrated and is identified by the numeral 50. The clip is a molded plastics product having legs 74, 76, and 78. The ends of the legs are bent back at 80 to receive an identification plate (not shown). The back of the identification clip 50 is provided a yieldable socket 82 allowing the clip to be clipped onto the bar 48, for instance, of the embodiment shown in FIGS. 4 and 5.

I claim:

1. In a merchandising unit of the type including a vertical display wall having a consistent pattern of discrete openings for receiving hook-type brackets suspending a rack, a combination of a rack having frame means extending from at least a bracket wherein part of the frame defines a closed loop in the form of a collar, and a container including a top opening and a rim defined about the opening wherein the rim includes a flange having a greater outer dimension than any other portion of the container below the rim, the dimensions of the collar of the rack being such as to allow the container to be inserted therein, from above the rack, and to engage the flange of the rim so as to at least partly support the container by the flange of the rim, and;

wherein the container is a semi-rigid lightweight tray, and the rack is provided with bottom support elements extending from rods forming the loops to support the bottom of the tray.

2. A combination of a rack and container as defined in claim 1, wherein the rack is a wire rack and the collar is made up of wire rods forming the closed loop and the loop conforms to the outline of the rim on the container.

3. A rack and container combination as defined in claim 1, wherein the rack is a wire rack, and the collar is made up of wire rods forming the closed loop conforming to the outline of the rim on the container, and the container is a rigid container supported in suspension by the flange of the rim.

4. In a merchandising unit of the type including a vertical display wall having a consistent pattern of discrete openings for receiving hook-type brackets suspending a rack, a combination of a rack having frame means extending from at least a bracket wherein part of the frame defines a closed loop in the form of a collar, and a container including a top opening and a rim defined about the opening wherein the rim includes a flange having a greater outer dimension than any other portion of the container below the rim, the dimensions of the collar of the rack being such as to allow the container to be inserted therein, from above the rack, and to engage the flange of the rim so as to at least partly support the container by the flange of the rim, and;

wherein the rack is a wire rack including a frame made up of wire rods with rear and front limits of the frame, and an enlarged metal rod of circular cross-section extending at the front limit of the frame to receive a removable molded plastics identification clip which has an identification card-receiving portion, and a socket to clip onto the rod.

5. A merchandising method including the use of vertical display panels at the point of sale and the provision of racks having suspension brackets on the display panels, each rack including at least a frame defining a collar for receiving a container having a rim wherein the rim is of a dimension greater than any portion of the container below the rim for insertion within the collar and for support on the rack by the collar, the method including the steps of selecting a suitable container of a material capable of being recycled, including filling, cleaning, refilling, and transporting, filling the container and sealing the open top thereof, shipping the container to the point of sale, inserting the container in a collar on a rack on the display panel, removing the sealed portion of the top, exposing the bulk products within the container, returning the container when emptied to the filling site, cleaning the container, refilling and resealing the container prior to returning it to the point of sale.

* * * * *